United States Patent [19]

Berthiaume

[11] 4,116,610

[45] Sep. 26, 1978

[54] COMBUSTION PROCESS

[75] Inventor: Camille Berthiaume, Hampton, N.H.

[73] Assignee: Columbia Chase Corporation, Braintree, Mass.

[21] Appl. No.: 735,635

[22] Filed: Oct. 26, 1976

Related U.S. Application Data

[63] Continuation-in-part of Ser. No. 612,109, Sep. 10, 1975, Pat. No. 4,008,038.

[51] Int. Cl.[2] ..... F23J 7/00

[52] U.S. Cl. ..... 431/4; 44/51

[58] Field of Search ..... 431/2, 4, 6, 190, 11, 431/9, 3; 44/51

[56] References Cited

U.S. PATENT DOCUMENTS

| | | | |
|---|---|---|---|
| 3,741,712 | 6/1973 | Delatronchette | 431/190 |
| 3,766,942 | 10/1973 | Delatronchette | 431/4 X |
| 3,809,523 | 5/1974 | Varekamp | 431/4 |
| 3,860,384 | 1/1975 | Vulliet et al. | 431/4 |
| 3,958,915 | 5/1976 | Noda et al. | 431/4 X |

*Primary Examiner*—Edward G. Favors

*Attorney, Agent, or Firm*—Robert A. Cesari; John F. McKenna; Andrew F. Kehoe

[57] ABSTRACT

An improved combustion process including emulsification of oil and water and conveying the emulsified oil and water, in the presence of some dispersing gas, under pressure into a combustion chamber where the gas aids rapid and excellent atomization of the emulsion.

10 Claims, 7 Drawing Figures

COMBUSTION PROCESS

RELATED APPLICATION

This application is a continuation-in-part of U.S. Ser. No. 612,109 filed on Sept. 10, 1975, by Camille J. Berthiaume now U.S. Pat. No. 4,008,038.

BACKGROUND OF THE INVENTION

The use of water, in various quantities and forms, as an additive to provide improved combustion of hydrocarbon fuels and waste gases is old.

Such processes have been proposed for various purposes: e.g. avoiding unsightly smoke from refinery waste-gas flares and improving the economics of home-type oil burner systems. These processes have included adding the water to the combustible as liquid, or as vapor, and in a very broad range of percentages.

Among the U.S. patents illustrative of such processes are those which utilize very high levels of water (U.S. Pat. No. 2,104,311) and very low levels of water (U.S. Pat. No. 3,862,819). Some patents disclose mixing of the water with the oil (U.S. Pat. No. 3,706,942) and some use the water in the form of a vapor catalyst — often injecting the water as vapor. While some of the processes suggested in the art are probably of little value because they use too little or too much water, it may be safely assumed that, when operating at equilibrium, a substantial advantage in some combustion characteristics is achieved with many of the processes described in the art.

Nevertheless, substantial problems remain in implementing such processes commercially. The high combustion efficiencies to be realized are accompanied by the use of less secondary air. This means that more water of combustion is in a given volume of stack gas and undesirably high dew points are experienced. Simultaneously, the efficient high-temperature process in the furnace results in a highly efficient heat transfer in a properly designed furnace. This further decreases the amount of waste heat and also tends to increase the probability that a stack gas temperature will fall below its dew point.

Even when the dew point is generally maintained at a minimum practical level, any temporary fluctuation in draft conditions can cause serious condensation problems in the heat transfer and stack-gas handling portions of a heating system. What is required is a dependable, stable means to operate a water-catalyzed combustion process at something approaching a steady state. Problems relating to flame stability, to reignition, and even to the usual changes in draft air or in heating loads within a furnace, must be minimized. All this is ideally achieved without sacrificing any of the substantial combustion efficiency, which is attainable with $H_2O$-promoted combustion.

SUMMARY OF THE INVENTION

It is a principal object of the invention to provide an $H_2O$-promoted combustion process of hydrocarbon liquid which provides a flame of improved stability and exceptionally high efficiency.

Another object of the invention is to provide such a process which can be utilized in large industrial heating plants and in power generating plants as well as in smaller residential units.

A further object of the invention is to provide a process as described above which does not require utilization of supplementary combustion catalysts.

Another object of the invention is to provide a means for achieving a more stable and more efficient combustion process.

A further object of the invention is to utilize a mixture of water and fuel oil to aid the emulsification of a dispersing fluid, especially a gaseous dispersing fluid like air or steam, into the mass of the fuel to be burned.

Other objects of this invention will be obvious to those skilled in the art on reading this disclosure.

The above objects have been substantially achieved by development of a process wherein (1) The liquid hydrocarbon fuel to be burned is emulsified with a fluid which will expand rapidly when the fuel is discharged through a nozzle (i.e. burner head) into a furnace; usually a substantial amount of water, 5 to 15% by weight based on fuel, is vigorously agitated with the expansion fluid and the fuel to be burned. This is believed to aid the emulsification of the fuel with the expansion fluid.

(2) A substantial amount, typically 5 to 20% by weight, of $H_2O$ is contained in a vapor atmosphere into which the emulsified hydrocarbon is expanded and burned. This vapor-bearing atmosphere may be provided around the burner head or, provided through the burner head, or provided by mixing air from a source proximate to the burner head with $H_2O$ which is contained in the dispensing fluid injected through the burner head. The $H_2O$ can include both steam and water used in the emulsification step.

This combination of extraordinary dispersal of atomization of the hydrocarbon vapor at the burner head and vaporized water provides an extremely efficient, stable flame.

Of particular importance, however, is the ability to achieve this flame with little, if any, excess oxygen. Consequently, it is believed that any excessive formation of $SO_3$ can be substantially avoided. Also, as those skilled in the art will realize from reading this disclosure, such a highly efficient combustion will minimize the amount of nitrogen which must be heated, will allow highly efficient heat exchange, primarily through radiation, and allow greatly reduced stack temperatures and, most importantly, provide a process which allows more stability and consequently a more dependable ratio of the selected stack gas temperature.

It is not known precisely why the process exhibits such extraordinary efficiency and stability. It is thought that the gaseous material, e.g. air or steam, is more efficiently emulsified when using the vigorous gas/-water/hydrocarbon contact step and that this results in an intimately mixed feed which, upon exiting the burner head, disperses with such rapidity to such small droplets that the rate of combustion of the fuel mass being fed to the furnace is achieved with an unusual combination of rapidity and efficiency. The presence of water vapor in the zone into which this rapid combustion takes place is believed to provide a stabilizing "brake" on the combustion rate, thereby providing a highly efficient and practical process. It is usually convenient to utilize excess gas from the conditioning tank as an atomizing fluid at the burner head. Normally such excess gas, be it air or steam or the like, will have picked up some fuel in the conditioning tank.

It has been observed that the flame produced by the most efficient use of the process is a vivid greenish color; this color seems to characterize the quality of the more efficient processes operated according to the invention. However, it should be realized advantage is also achieved at temperatures below those at which the green flame is noticed.

Finely divided and fluidized coal can also be pumped to an appropriate burner head, under pressure and in the presence of a pressurized and vaporizable fluid, and dispersed into a water-vapor bearing shroud. It is contemplated that the dispersing fluid is advantageously a different fluid from the primary fluidizing medium. For example, if the primary fluidizing agent is air, the dispersing fluid may be steam or a lighter hydrocarbon; if the primary fluidizing agent is water, the dispersing agent could be, again, a hydrocarbon such a liquified petroleum gas. In any event, the important aspect of this coal-combustion process is to utilize the expansion of gas at the burner head, as it emerges from the nozzle, to disperse the coal dust into a highly humidified atmosphere.

It is desirable to preheat the heavier liquid hydrocarbon fuels. In general, it is not necessary to preheat No. 2 oil, and other such less viscous oils, under most temperature conditions. The preheating can be achieved by mixing with a heated fluid, such as steam used as a dispersing fluid, or by any other heating means known to the art.

It is also advantageous, in some situations, to utilize the process of the invention in a mode wherein some hydrocarbon fuel is carried into the zone around the burner head in the water vapor bearing air. Normally, the amount of such fuel will be less than will allow the air to support combustion by itself. Nevertheless, the smaller quantities of hydrocarbon seem to enhance the quality and stability of the combustion.

ILLUSTRATIVE EXAMPLES OF THE INVENTION

In this application and accompanying drawings there is shown and described a preferred embodiment of the invention and suggested various alternatives and modifications thereof, but is is to be understood that these are not intended to be exhaustive and that other changes and modifications can be made within the scope of the invention. These suggestions herein are selected and included for purposes of illustration in order that others skilled in the art will more fully understand the invention and the principles thereof and will be able to modify it and embody it in a variety of forms, each as may be best suited in the condition of a particular case.

IN THE DRAWINGS

EMBODIMENTS OF THE INVENTION

Figure 1:
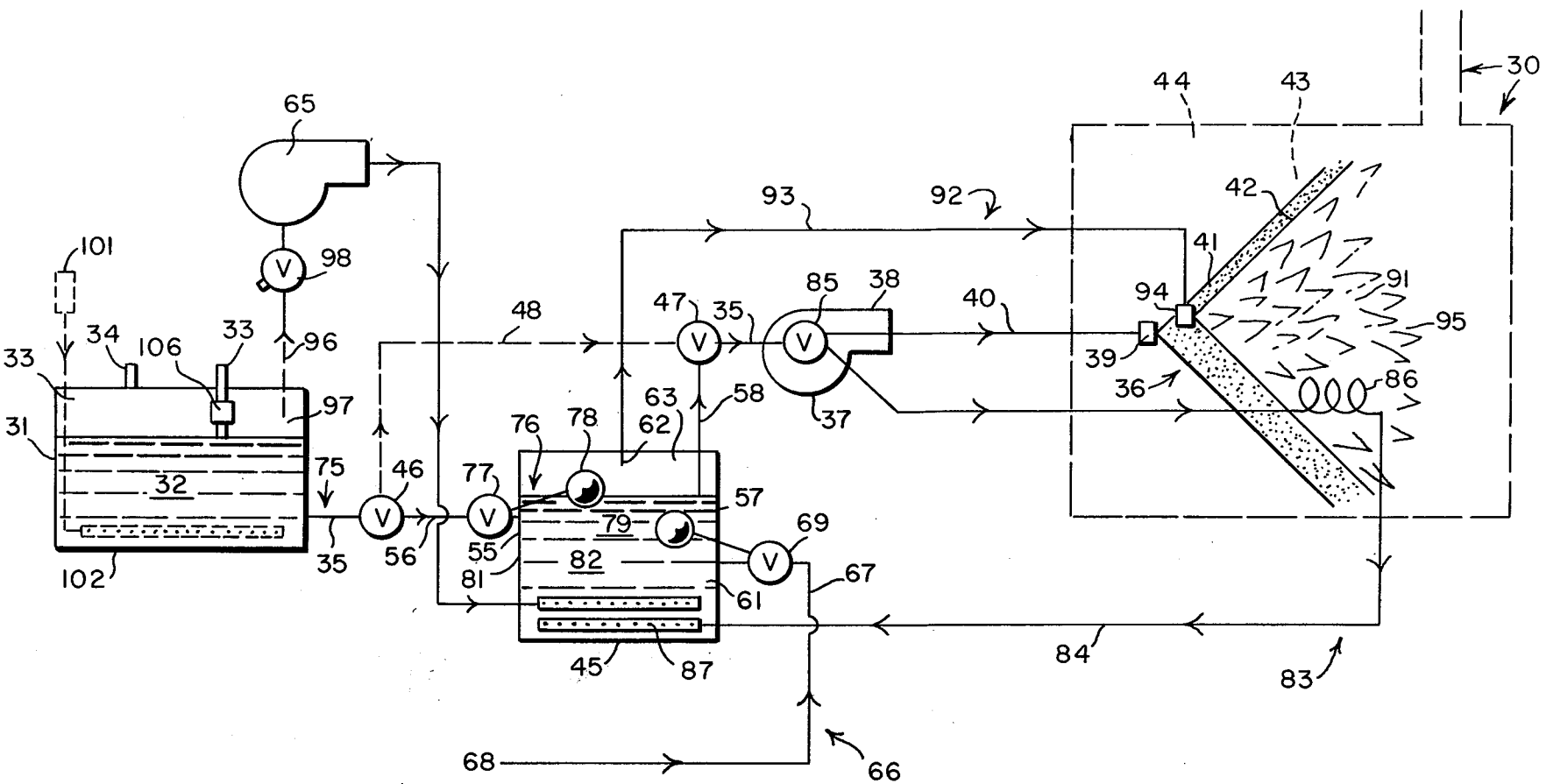
FIG. 1 is a diagrammatic view of the fuel conditioning apparatus of the invention.
Figure 2:
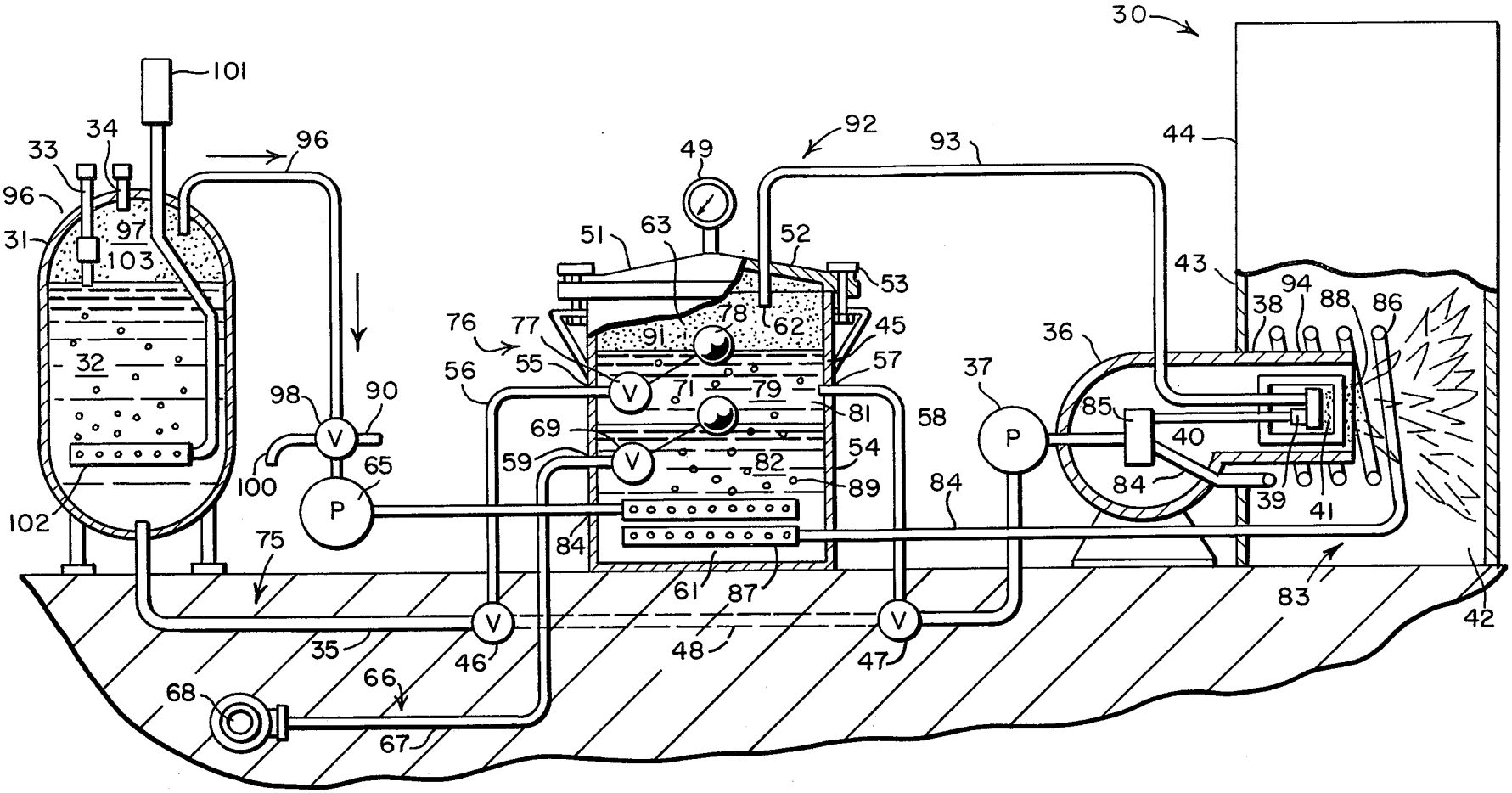
FIG. 2 is a side elevational view of a residence type oil burner system with the apparatus of the invention incorporated therein, parts being broken away and in half section, for clarity.

As shown in FIGS. 1 and 2, the apparatus and method of the invention is incorporated into a typical home heating system 30 of the type having an oil tank 31, usually capable of holding about 200 gallons of liquid oil 32, there being an air vent 33 and a filler pipe 34. A fuel line 35 normally extends to a conventional oil burner 36 having a motorized fuel pump 37, a gun, or barrel, 38, and a burner tip 39. Tip 39 emits atomized fuel 41 in a flame of generally conical configuration, 42, into the combustion chamber 43 of the hot air, hot water, steam or other type heating unit 44, upon call of thermostats, all in a well known manner.

In this invention, a pressure tank 45 is interposed in liquid fuel line 35 by means of valves 46 and 47, so that the portion 48 therebetween may be used, if conventional heat is desired, but portion 48 is bypassed when the supplementary heat of the invention is desired. The line portion 48 is shown in dotted lines for clarity in FIG. 2. A pressure gauge 49 indicates the pressure within tank 45, the pressure being relatively low and about 5 psi. The tank 45 includes a top closure 51 sealed around the peripheral flanges 52, by suitable threaded clamps 53 to the bottom, or base, 54.

Tank 45 includes a liquid fuel inlet 55, connected by conduit 56 to valve 46, for receiving oil from tank 31 and a liquid fuel outlet 57 connected by conduit 58 to valve 47 for delivering oil from tank 45 to the burner 36. Tank 45 also includes a water inlet 59 in the lower portion 61 of the tank and a vapor, or fume, outlet 62 in the upper portion, or vapor chamber, 63 of the tank. An air, or vapor, inlet 64 leads from a motorized air pump 65 for feeding pressurized air into the tank 45 to create the desired vapor pressure and turbulence therein. This air is emulsified in the oil and will act as the dispersing fluid therein.

Water supply means 66 is provided, including the water pipe 67 connected to a source of water under pressure such as the house main 68 and having a normally closed solenoid valve 69 which is opened to admit water into the lower portion 61 of tank 45 when a signal is received from suitable level sensing means such as a pair of electrodes 71 and 72 in a circuit 73 including the coil 73 of valve 69 and a source of 110-volt current 74. A float valve, photo cell or any other suitable means may be used to maintain a predetermined level of water in tank 45 to form a layer of water of predetermined thickness, or height therein, all in a known manner.

The liquid fuel supply means 75 of the invention included the oil tank 31, fuel lines 35 and 56, valves 46 and 47, liquid inlet port 55, tank 45, liquid outlet port 57, fuel line 58, liquid fuel pump 37 and the burner tip 39.

Automatic liquid fuel control means 76 is provided in the form of a valve 77 opened and closed by a float 78 riding on the layer of oil 79 in the intermediate portion 81 or tank 45, the layer 79 of oil floating on the layer 82 of water in the lower portion 61 of tank 45.

The vaporized fuel formation means 83 includes a bypass, or recirculation, liquid fuel line 84, leading from the joint 85 in fuel line 58, in rear of the fuel pump 36 and in advance of the burner tip 39, to conduct liquid oil under pump pressure through a pre-heating coil, or jacket, 86, and thence to an outlet 87, preferably in the form of a perforated bubbler tube, in the lower portion 61 of tank 45 below the predetermined level of the water layer 82. The heating coil 86 preferably encircles the gun, or barrel, 38 of burner 36 and extends beyond the end 88 thereof so that some of the convolutions are in the path of the truncated conical flame 42 in the combustion chamber 43. Thus each time the thermostatic, or other, controls of oil burner 36 close the circuit to energize pump 37, liquid fuel under pressure is delivered to burner tip 39 for atomization, ignition and flame. Simultaneously a portion of the pressurized liquid fuel is heated in coil 86 and delivered to the outlet 87 to produce heated bubbles 89 of oil which rise upwardly through the water layer 82 and upwardly through the liquid oil layer 79 to form enriched vapor, or fumes 91 in the upper portion, or vapor chamber, 63, of the pressure tank 45.

The enriched vapor supply means 92 of the invention includes the vapor outlet 62 of tank 45 and the vapor conduit 93 leading to the vapor burner tip 94 which is located in combustion chamber 43 in the path of the flame 42, just in front of, and below the level of, the burner tip 39. Thus the vapor 91 is ignited by the flame 42 to supplement the heat produced by the burner tip and form a flame pattern 95 as shown diagrammatically in FIG. 1.

Vapor pressure of about 5 psi is achieved in the upper portion 63 of tank 45 by the motorized air pump 65 which is in circuit with fuel pump 37 so as to be energized for each period that the fuel pump is energized by the heat controls. As shown air pump 65 may draw fumes through influent conduit 96 from the upper portion 97 of fuel tank 31, or may draw fresh ambient air from the atmosphere by means of two way valve 98. Preferably, however, as shown in dotted lines the tank vent 33 sealed, so that pump 65 draws fresh air from inlet 101, drives the air into a perforated tube bubbler 102 and thereby creates enriched fumes 103 under pressure in the upper portion 97, which pressurized fumes are conducted through line 96 to the upper portion 63 of tank 45, and thence to the vapor burner tip 94.

Figure 3:
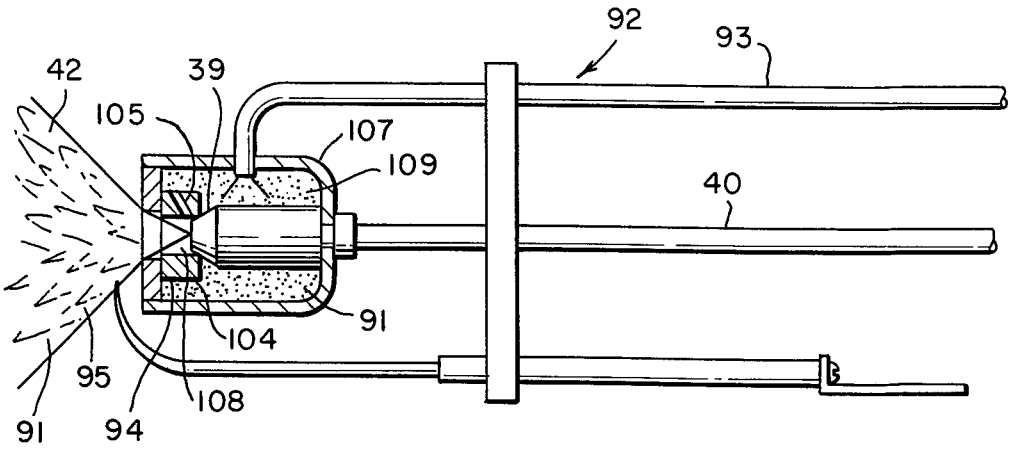
FIG. 3 is an enlarged fragmentary side elevation view of the firing unit of the invention.
Figure 4:
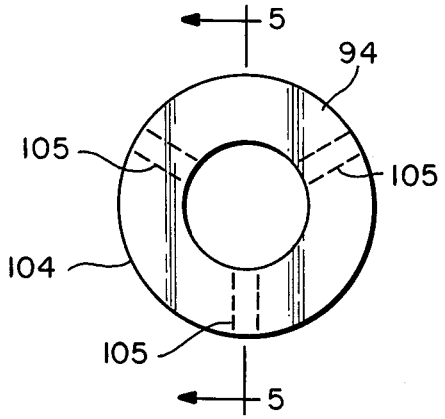
FIG. 4 is a plan view.
Figure 5:
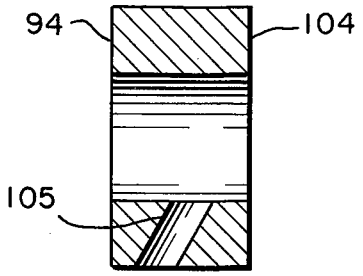
FIG. 5 is a side elevation in half section of the vapor burner tip shown in FIG. 3.

As shown in FIGS. 3, 4 and 5 the vapor burner tip 94 is preferably in the form of a threaded nipple 104 having at least one orifice 105, and preferably three thereof as shown in FIG. 4. The preferred location for tip 94 is shown in FIG. 3 with the orifices 105 just below the level of the longitudinal centre line of burner tip 39.

EXAMPLE NO. 2

The following example is carried out in an auxilliary furnace used by a large utility to generate steam for use in power generation. The furnace, or "boiler" as it is commonly called, has 5520 designed of heating surface and is desigend to produce about 40,000 to 80,000 lbs of saturated steam at 250 psig: It is equipped with 240 tubes (2-inch diameter and 0.150 wall thickness) in its furnace section and 448 similarly-sized tubes in its convection section.

Figures 6, 7:
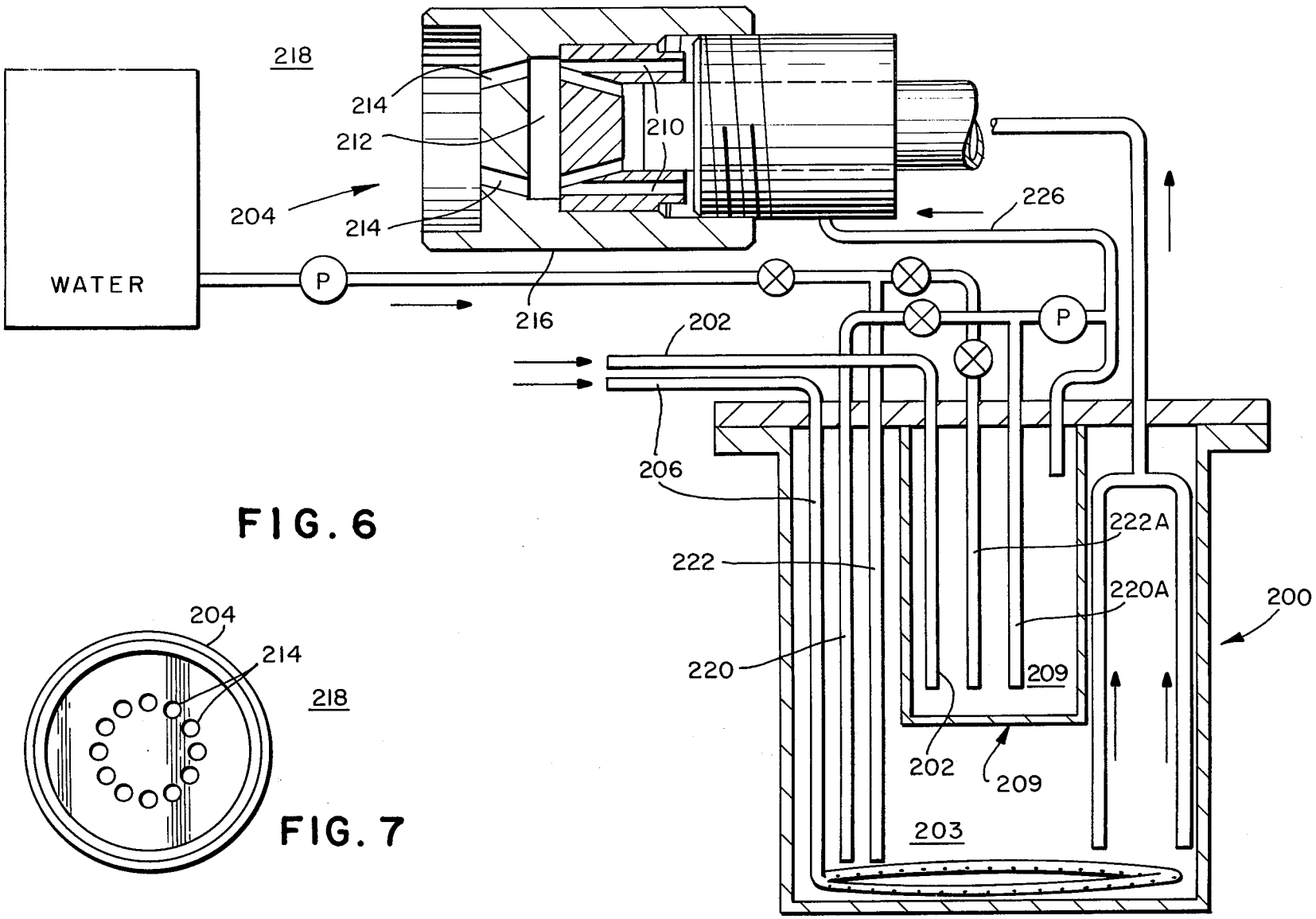
FIG. 6 is a schematic diagram showing the use of steam as an emulsifying fluid in the process of the invention.
FIG. 7 is a view of the face of the nozzle of FIG. 6 as it faces into a combustion chamber.

The furnace is equipped with a firing head 204, a fuel-conditioning unit 200 as shown schematically in FIG. 6.

Fuel is No. 2 oil and it is supplied at a rate of 300 gallons per hour.

Steam at 100 psig, is supplied at a rate which is commensurate with the normal steam-atomization procedures known to the art.

Air is added to the burner in a swirling pattern about the periphery of the burner head in a quantity of about 1% greater than that required to achieve a 100% theoretical combustion of the fuel.

The following example illustrates the furnace being operated to produce about 40,000 lbs of steam per hour.

Referring to FIG. 6, it is seen that the fuel is piped into conditioning zone 209 of conditioning unit 200 through conduit 202 wherein it is preheated (and otherwise conditioned, as will be described below) before being sent to firing head, or nozzle, 204, through conduit 226.

Steam comes through conduit 206 into the outer conditioning zone 203 of conditioning unit 200 wherein it is mixed with some water and oil. The steam thus "conditioned" or enriched is then fed to nozzle 204 and nozzle conduits 210 to merge and mix with fuel in integrator section 212. Thence the mixture is passed through nozzle conduits 214 to atomize and disperse within combustion chamber 218.

It is noted that some oil is supplied to outer conditioning zone 203 of conditioning unit 200 via oil-supplement tube 220 wherein it is mixed with steam. Water is similarly supplied via water-supplement tube 222. This mixing action of steam, water and oil impart a small, very well-dispersed quantity of oil into the steam, which is to act as the dispersing fluid. The amount of oil so added will be small, usually well below the 1% of total hydrocarbon fuel fed into the furnace and will not make the resulting dispersing fluid combustible, by itself; but, nevertheless, is believed to aid process combustion stability and the efficiency of combustion.

Water is added at a rate of about 5 to 8% by weight of fuel oil. This quantity of water is adequate to aid the emulsification of oil, steam and water for delivery to the burner head through the fuel conduit. Excess steam, carrying some hydrocarbon, is carried through the steam conduit for use as atomizing gas. About 60 to 80% of this water is added to the oil, via conduit 222A, in inner vessel 209. The rest is added to the steam-jacket zone 203 via conduit 222. Similarly, steam is added, through conduit 220A, to the oil and water within inner vessel 209 to help form the desired steam-emulsified oil mixture to be fed through conduit 226 to burner head 204.

When the steam-emulsified hydrocarbon is passed from a higher pressure into the burner head and thence into furnace zone, or combustion chamber 218, the fluid expands rapidly to disperse the oil-bearing feed. Use of a $H_2O$ bearing dispersing gas helps provide an exceptionally compatible atmosphere into which the emulsified hydrocarbon can be instantly dispersed and burned. As indicated in the example above, a relatively small quantity of oil pre-existing in the $H_2O$ bearing dispersing gas seems to markedly improve combustion characteristics.

The resulting combustion reaches a temperature of about 3000° F. The efficiency of the combustion is about 96%. Temperatures of about 3200° F and combustion efficiencies approaching 100% can be achieved in many installations by further cutting back of the oxygen.

It should be realized that the above description is given for illustrative purposes only. Continued operation of the process at elevated temperatures should not be attempted unless the particular boiler or furnace is carefully evaluated for its ability to withstand the temperatures inherent in the process.

It is to be understood that the following claims are intended to cover all of the generic and specific features of the invention herein described and a statement of the scope of the invention which might be said to fall therebetween.

What is claimed is:

1. A process for burning liquid hydrocarbons at high temperatures within the confines of a combustion chamber, said process comprising the steps of:

(i) emulsifying said hydrocarbon with a water and a gaseous dispersing fluid to form a fuel emulsion, (ii) passing said emulsion under a higher pressure to a burner head and into a furnace at a lower pressure, causing said dispersing fluid to expand and dispense said fuel emulsion.

2. A process as defined in claim 1 wherein said fuel emulsion is dispersed into a water-vapor-bearing atmosphere in which said emulsion is dispersed and in which said liquid hydrocarbons are burned.

3. A process as defined in claim 1 wherein said dispersing fluid is air.

4. A process as defined in claim 2 wherein said water-vapor-bearing atmosphere comprises three to 13% of water vapor or steam.

5. A process as defined in claim 2 wherein said water-vapor-bearing atmosphere comprises a quantity of hydrocarbon fuel which is insufficient to support combustion.

6. A process as defined in claim 4 wherein said water-vapor-bearing atmosphere comprises a quantity of hydrocarbon fuel which is insufficient to support combustion.

7. A process as defined in claim 1 wherein said dispensing fluid is steam.

8. A process as defined in claim 2 wherein said water-vapor-bearing atmosphere comprises a quantity of hydrocarbon fuel which is insufficient to support combustion.

9. A process as defined in claim 1 wherein said emulsifying includes the step of intimately contacting some steam, water and a small portion of said fuel in a conditioning zone, mixing effluent from said conditioning zone with fuel, and supplying the resultant mix to said burner head.

10. A process as defined in claim 9 wherein said process is operated with a quantity of water fed into said conditioning zone which is equal to about 5% of hydrocarbon fuel burned in said process.

* * * * *

UNITED STATES PATENT OFFICE

CERTIFICATE OF CORRECTION

Patent No. 4,116,610 Dated September 26, 1978

Inventor(s) Camille Berthiaume

It is certified that error appears in the above-identified patent and that said Letters Patent are hereby corrected as shown below:

Column 4, line 59: change "or" to --of--

Column 4, line 63: change "36" to --37--

Column 5, line 51: change "designed" to -- feet$^2$ --.

Claim 7, line 11: change "dispense" to --disperse--

Signed and Sealed this

*Seventeenth* Day of *April 1979*

[SEAL]

*Attest:*

RUTH C. MASON
*Attesting Officer*

DONALD W. BANNER
*Commissioner of Patents and Trademarks*